United States Patent [19]

Fitzgerald et al.

[11] 4,317,060

[45] Feb. 23, 1982

[54] BOWL MIRRORED LAMP

[75] Inventors: John Fitzgerald; Jan A. H. Kesseler, both of Eindhoven, Netherlands

[73] Assignee: U.S. Philips Corporation, New York, N.Y.

[21] Appl. No.: 86,564

[22] Filed: Oct. 19, 1979

[30] Foreign Application Priority Data

Oct. 30, 1978 [NL] Netherlands ..... 7810774

[51] Int. Cl.[3] ..... H01J 3/14

[52] U.S. Cl. ..... 313/113; 313/315

[58] Field of Search ..... 313/113, 273, 279, 222, 313/315, 115

[56] References Cited

U.S. PATENT DOCUMENTS

| | | | |
|---|---|---|---|
| 2,115,839 | 5/1938 | Briefer | 313/113 |
| 2,181,291 | 11/1939 | Biggs | 313/113 |
| 2,218,345 | 10/1940 | Spaeth | 313/217 |

*Primary Examiner*—Ernest F. Karlsen

*Attorney, Agent, or Firm*—Robert S. Smith

[57] ABSTRACT

Bowl mirrored lamps according to the invention have a filament which is arranged asymmetrically with respect to the axis of the lamp envelope and surrounds the axis over an angle greater than 180° in such a manner that it does not coincide at any point with the image of the filament formed by the mirrored bowl portion of the lamp envelope.

As a result of this filament positioning the lamp can in combination with a reflector provide a light beam having a very high central intensity.

3 Claims, 8 Drawing Figures

BOWL MIRRORED LAMP

The invention relates to a bowl mirrored incandescent lamp having a lamp envelope which comprises a generally spherically curved mirrored bowl portion and an adjoining light-pervious portion provided with a lamp cap at its end remote from the bowl portion, and a filament accommodated in said lamp envelope near the center of curvature of the mirrored bowl portion of the lamp envelope.

Such a bowl mirrored lamp is disclosed for example, in U.S. Pat. No. 2,070,700, FIG. 14 of which shows a four-section filament the two inner sections of which extend in a plane substantially perpendicular to a plane in which the two outer sections are located.

Bowl mirrored lamps have for their object to provide a narrow light beam of high intensity in conjunction with an external reflector. Theoretically, the concentrating effect of the bowl mirror is maximum, and a light beam of uniform intensity is obtained, if the filament were concentrated in a point, i.e. punctiform, and arranged in the center of curvature of the bowl mirror and also in the focus of the external reflector. However, the use of punctiform filament, or even of a filament approaching a punctiform, is not possible in practice because flashover between the current supply conductors to the filament or between adjacent parts of the filament would occur. In practice a filament having an approximately part circular form is used with its effective center arranged concentric with the center of curvature of the bowl mirror (see, for example U.S. Pat. No. 1.977,612).

However, the above-mentioned U.S. Pat. No. 2,070,700 states that, when a filament is accommodated concentrically with the mirrored bowl, the image, or reproduction, of the filament formed by the mirrored bowl coincides partly with the filament. As a result of this the filament locally obtains a higher temperature so that the material of the filament will evaporate more rapidly in that region and a further rise in temperature occurs, causing a premature end of life of the lamp. According to the U.S. Pat. No. 2,070,700 the filament is therefore accommodated so as to be located entirely to one side of a plane through the axis of the lamp envelope. As a result of this the bowl mirror forms the reproduction of the filament entirely on the other side of said plane. Although the lamp known from this patent has a life which corresponds to the computed life, the beam formed by the lamp and reflector is as wide as that of a lamp having a filament which is twice as long and is concentric with the axis of the bowl mirror. In addition, the light beam formed varies in intensity over its cross section and the intensity in the center of the beam is small. It is the object of the invention to provide bowl mirrored lamps which have at least the same life as, but gives a light beam having a higher central intensity than, this known lamp.

According to the invention this object is achieved in bowl mirror lamps of the type defined in the opening paragraph in that the filament is arranged asymmetrically with respect to the axis of the lamp envelope and surrounds said axis over an angle greater than 180° in such a manner that it does not coincide at any point with the image of the filament formed by the mirrored bowl portion of the lamp envelope. It has been found that a relatively compact configuration of the filament about the lamp axis can be obtained without having recourse to the provision of angles between adjacent sections of the filament of 90° or less. Such acute angles may cause unequal stresses in the sections of the filament and may result in a shorter life.

Generally, the adjacent sections of the filament enclose an angle between 100° and 150°, preferably between 115° and 135°. With the last-mentioned range, a filament can be arranged so as to be, together with its reproduction, relatively compact compared with known lamps, while at the same time allowing equal stresses to be realized in the sections of the filament.

In order to achieve that the sections of the filament have the same temperature profile during operation, the sections of the filament are preferably of equal length.

With the aforesaid asymmetric arrangement of the filament with respect to the axis of the lamp envelope, the filament and its reproduction surround each other partly, and both the filament and its image extend on each side of any plane through the axis of the lamp envelope. As a result of this, the filament and its image together are more compact, i.e. less extended from the axis, than if they were located one on either side of a plane through the axis of the lamp envelope, whereas they nevertheless do not overlap at any point.

The axis of the lamp envelope preferably extends between sections of the filament at a distance of at least 2 mm from an imaginary line joining the ends of the filament.

Lamps according to the invention moreover permit of obtaining light beams, by use of a reflector, of a more uniform intensity.

The filament of a lamp according to the invention can be arranged to lie in one plane, but if desired the two outermost sections may extend ten or a few tens of degrees out of the plane in which the remaining sections lie. Apart from the stated differences, the general position of the filament is in accordance with that of conventional lamps; that is to say that the filament lies near the center of curvature of the mirrored bowl portion of the lamp envelope, for example in a range a few millimeters above to a few millimeters below the center of curvature in the axial direction of the lamp envelope. Also, the filament generally extends in a plane transverse to the axis of the lamp envelope. Alternatively, the "lowest" point of the filament may be located, for example, in a transverse plane 2 mm below the center of curvature in the axial direction and the "highest" point may be located in a transverse plane 2 mm above the center of curvature.

The lamps according to the invention also have in common with conventional lamps that the line along which the mirrored bowl and the light pervious lamp envelope portions adjoin lies approximately at the level of the center of curvature, dependent on the type of reflector for which the lamps are intended. The mirrored bowl portion may be mirrored by means of a layer of silver or of aluminium or any other suitable light reflecting material.

The mirrored bowl portion of the lamp envelope may have a more gradual curvature in the immediate proximity of the point where the axis of the lamp envelope intersects the lamp envelope. Lamps having such a lamp envelope have, during operation, a lower temperature in the region of the lamp cap.

An additional advantage of the lamps according to the invention is that the more compact shape and the positionoing of the filament allow the filament assembly to be inserted in the lamp envelope via a smaller neck opening. This has advantages from a technical and economical point of view and, moreover, results in a lower operating temperature of the lamp cap.

Embodiments of lamps according to the invention will now be described with reference to the accompanying drawings. In the drawings.

Figure 1:
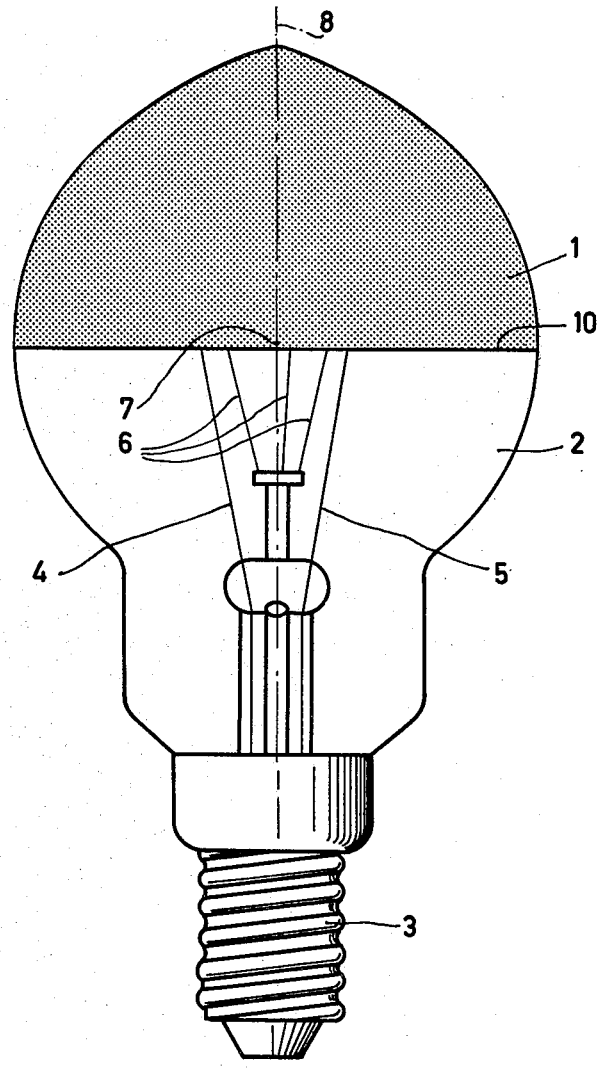
FIG. 1 is an elevation of a lamp according to the invention.

Reference numeral 1 in FIG. 1 denotes a generally spherically curved, mirrored lamp envelope portion of a mirrored bowl lamp, 2 denotes a light pervious portion of the lamp envelope having a lamp cap 3 at its narrow end. Current supply and support wires 4 and 5 lead to the filament, which filament cannot be seen by the eye, due to the silvering of the lamp envelope portion 1. The filament is further supported, between its ends, by intermediate support wires 6. The center of spherical curvature of the mirrored lamp envelope portion is denoted by 7 and lies on the axis 8 of the lamp envelope. The mirrored and the light pervious lamp envelope portions adjoin in a line 10 in a plane transverse to axis 8 and below the center of curvature 7 as viewed in the Figure, that is to say nearer to the capped end of the lamp.

Figure 2:
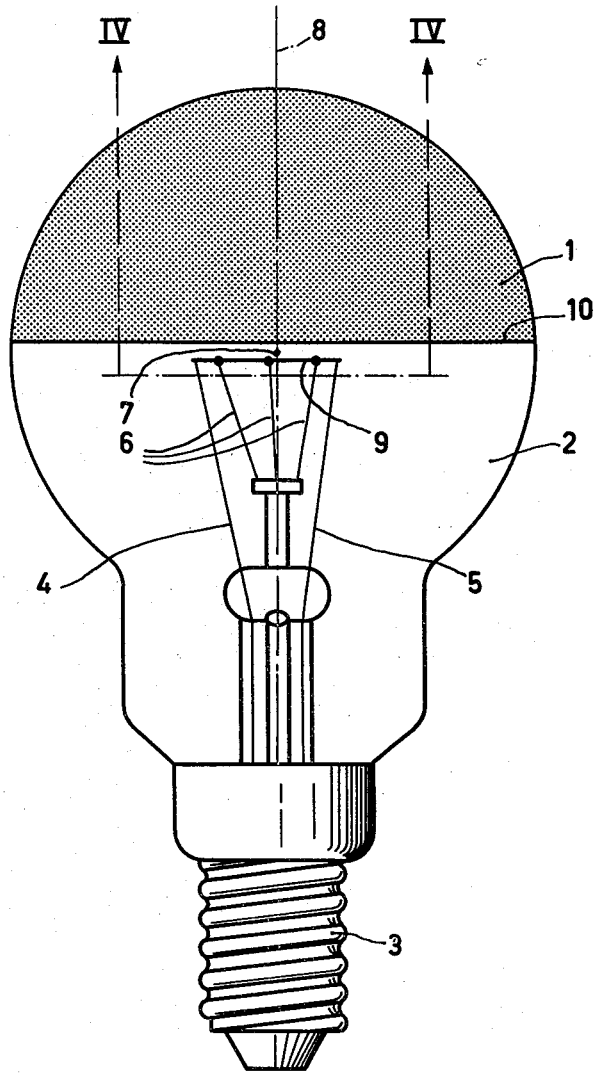
FIG. 2 is an elevation of a modified embodiment of the lamp shown in FIG. 1.

In FIG. 2, the reference numerals 1 to 8 and 10 correspond to those of FIG. 1. 9 denotes the filament which in this lamp lies in a plane below the center of curvature 7, whilst the line 10 lies in a plane above the center of curvature.

Figure 3:
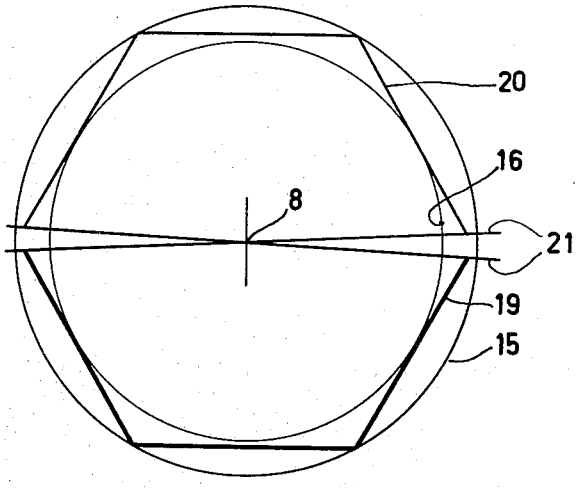
FIG. 3 shows a conventional filament with its image.

In FIG. 3 reference numeral 19 denotes a three-section filament differing only from the filament of a conventional commercially available mirrored bowl lamp in that the angles between adjacent sections of the filament at 120° instead of 135°. The point of intersection of the axis 8 of the lamp envelope with the plane of the drawing is shown. The image, or so-called reproduction, of the filament produced by the reflecting surface is denoted by 20. Several planes 21 exist which pass through the axis 8 but do not intersect either filament 19 or its reproduction 20; only the limiting planes being shown in FIG. 3. The smallest circumscribing circle of the filament and its reproduction is denoted by 15 and the largest inscribing circle is denoted by 16. The diameter of circle 16 is a measure of the compactness of the filament.

Figure 4A:
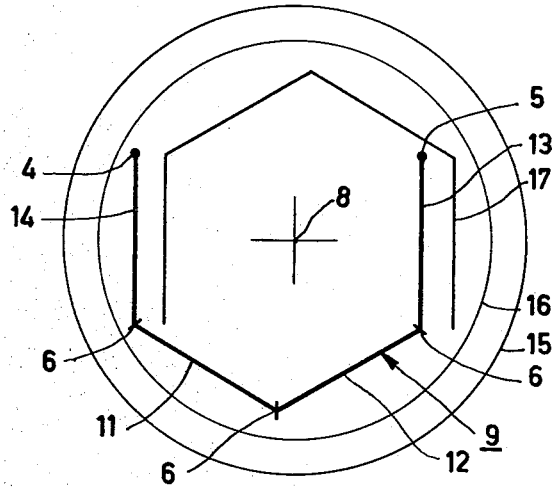
FIGS. 4*a* to 4*e* are cross-sectional views taken on the line IV—IV of the lamp shown in FIG. 2.

FIG. 4*a* is a cross-sectional view of an embodiment of a lamp in accordance with the invention, taken along the line IV—IV of FIG. 2. The filament 9 comprises four co-planar rectilinear sections 11 to 14, the outermost sections 13 and 14 being parallel. 17 Denotes the reproduction of the filament by the mirrored bowl (1 in FIG. 2). The current supply support wires in this Figure are denoted by 4 and 5 and the intermediate support wires by 6. The filament 9 has the same overall length as the filament 19 in FIG. 3. The angles between the adjacent sections of the filament are 120° as in FIG. 3. This FIG. 4*a* shows that the filament is positioned asymmetrically with respect to the axis 8 of the lamp envelope and surrounds the axis over an angle greater than 180°. As a result the filament 9 and its reproduction 17 partly surround each other. The filament and its reproduction extend on both sides of any plane through the axis of the lamp envelope.

FIG. 4*a* furthermore shows that the filament 9 and its reproduction 17 are located entirely within the circle 16 which, together with circle 15, has been drawn to the same scale as in FIG. 3. This more compact configuration gives, in combination with a reflector, a narrower light beam of a higher intensity in the center than in the case of FIG. 3. The filaments shown in FIGS. 4*a* to 4*e* are compared here with the filament shown in FIG. 3 because the comparison is immediately apparent, whereas the precise configuration of the filament shown in the U.S. Pat. No. 2,070,700 is not readily determinable.

Figure 4B:
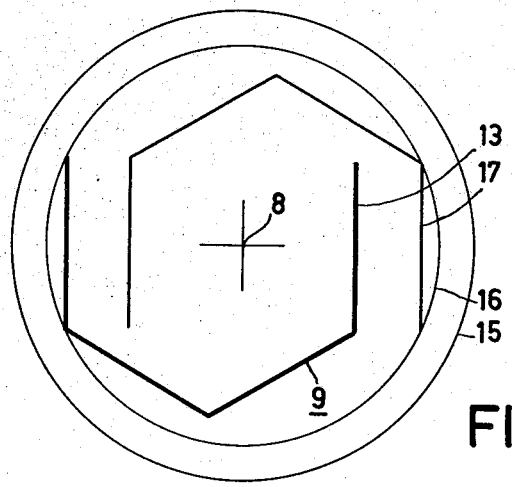

In FIG. 4*b* the eccentricity of the filament 9 with respect to the axis 8 of the lamp envelope is greater. In this case the light beam is slightly wider but still narrower than the light beam of the filament of FIG. 3.

Figure 4C:
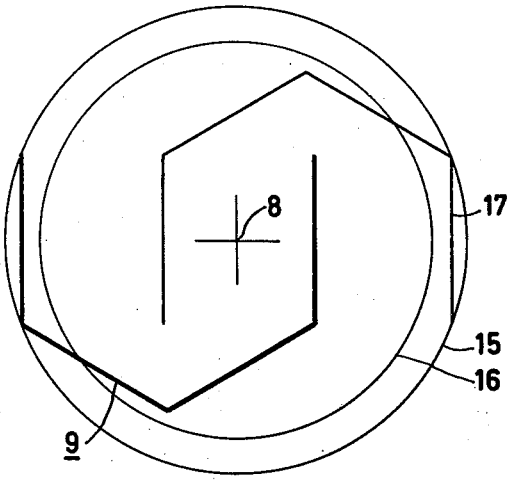

In FIG. 4*c* the eccentricity is even greater, but a part of the filament and its reproduction are located still closer to the axis 8 of the lamp envelope.

Figure 4D:
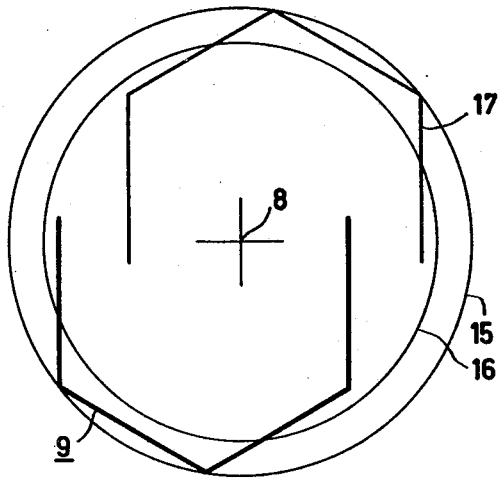

In FIG. 4*d* the filament 9 and its reproduction 17 interdigitate slightly less deeply. The axis 8 of the lamp envelope extends at a larger distance from the bottommost point of the filament as viewed in the Figure. When compared with FIG. 3, parts of the filament and its reproduction are however within circle 16, giving a higher central intensity of the light beam produced via a reflector.

Figure 4E:
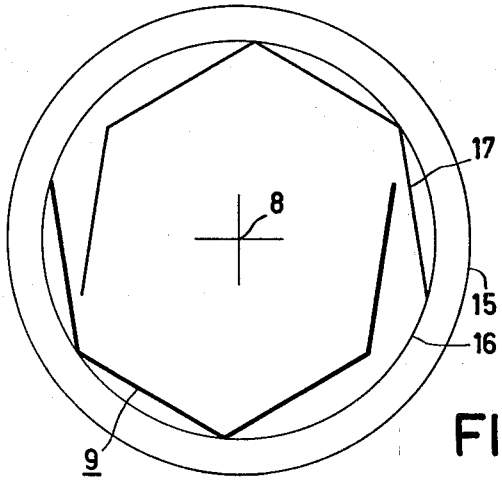

In FIG. 4*e* a filament 9 is shown having larger intersection angles. As a result of this the filament is less compact than in FIGS. 4*a* but nevertheless still gives a narrower beam than can be given by the filament shown in FIG. 3.

In every case, the intensity in the center of the light beams formed is larger than in the case of FIG. 3.

It is to be noted that, if the position of the filament 9 as shown in any of FIGS. 4*a* to 4*e* were shifted upwards as viewed in the Figure, a point would be reached where the filament 9 would partly overlap its reproduction 17. It should therefore be ensured that the filament is so located asymmetrically with respect to the axis of the lamp envelope, and surrounding the axis over an angle of at least 180°, that no overlapping of filament and reproduction occurs. This can be readily checked on introducing the filament into the lamp envelope.

EXAMPLE

A lamp as shown in FIG. 2 in which the filament was accommodated in the configuration and position shown in FIG. 4*b*, was operated at 220 volts while placed in a parabolic reflector. The lamp consumed a power of 100 Watts. Each of the sections of the filament had a length equal to $\frac{1}{4}$ of the overall length of the filament. The enclosed angles between adjacent sections were all 120°; that is, between 115° and 135°. The lamp was compared with a conventional lamp 100 Watt in which the filament had the configuration and the axial position shown in FIG. 3. With this latter filament the angles between adjacent sections were also 120°. The length of each section was $\frac{1}{3}$ of the overall length of the filament.

The results of the comparison are stated in the following table.

| | Filament FIG. 4b | Filament FIG. 3 |
|---|---|---|
| Central intensity of beam | 32000 cd | 18500 cd |
| Beam width angle | 2 × 3.7° | 2 × 5.5° |

The beam width angle is defined as twice the angle between the axis of the beam and the direction in which the light intensity is 50% of that in the center of the beam.

The lamps having the filament shown in FIG. 3 give a light beam which gives two kidney-shaped spots on a screen positioned at a distance of well over three meters from the lamp at right angles to the axis of the lamp. The lamps having the filament shown in FIG. 4*b* on the contrary give a more concentrated circular spot of great uniformity.

In the embodiments shown in FIGS. 4*a* to 4*e*, the filament sections lie in a common plane. Alternatively, the two end sections of the filament may lie in a plane at an angle of up to a few tens of degrees to the plane in which the remaining sections lie. The angles between adjacent sections of the filament preferably lie between 100° and 150°.

What is claimed is:

1. A bowl mirrored incandescent lamp having a lamp envelope which comprises a generally spherically curved mirrored bowl portion, an adjoining light-pervious portion provided with a lamp cap at its end remote from the bowl portion, and a filament accommodated in said lamp envelope near the center of curvature of the mirrored bowl portion of the lamp envelope, characterized in that the filament is arranged asymmetrically with respect to the axis of the lamp envelope and surrounds said axis over an angle greater than 180° in such a manner that it does not coincide at any point with the image of the filament formed by the mirrored bowl portion of the lamp envelope.

2. A lamp as claimed in claim 1 wherein the filament lies substantially in a plane transverse to the said axis.

3. A lamp as claimed in claim 2 wherein the filament is provided with supports at its ends and intermediately to form rectilinear filament sections between the supports, the angle between adjacent filament sections being between 100° and 150°.

* * * * *